US008536522B2

(12) United States Patent
Howes et al.

(10) Patent No.: US 8,536,522 B2
(45) Date of Patent: Sep. 17, 2013

(54) MASS SPECTROMETER

(75) Inventors: Kevin R. Howes, Manchester (GB); Ian Trivett, Manchester (GB); Paul Anthony Read, Lancashire (GB); Richard B. Moulds, Cheshire (GB)

(73) Assignee: Micromass UK Limited, Manchester (GB)

( * ) Notice: Subject to any disclaimer, the term of this patent is extended or adjusted under 35 U.S.C. 154(b) by 489 days.

(21) Appl. No.: 12/474,548

(22) Filed: May 29, 2009

(65) Prior Publication Data

US 2010/0301207 A1 Dec. 2, 2010

(51) Int. Cl.
*H01J 49/00* (2006.01)

(52) U.S. Cl.
USPC ..... 250/288; 250/282; 250/429

(58) Field of Classification Search
USPC ..... 250/288
See application file for complete search history.

(56) References Cited

U.S. PATENT DOCUMENTS 6,809,312 B1 * 10/2004 Park et al. ..... 250/281
7,723,700 B2 * 5/2010 Horsky et al. ..... 250/429

FOREIGN PATENT DOCUMENTS

JP 54-109895 8/1979
JP 63-299042 12/1988

OTHER PUBLICATIONS

International Search Report, Form PCT/ISA/210 for Application No. PCT/GB2010/050925, dated Oct. 8, 2010.
International Written Opinion, Form PCT/ISA/237 for Application No. PCT/GB2010/050925, dated Oct. 8, 2010.
Agilent Technologies, "Agilent LC/MS Ion sources", Maximizing LC/MS performance, www.agilent.com/chem/sources, 2007, p. 1 of 8.

* cited by examiner

*Primary Examiner* — Phillip A Johnston
(74) *Attorney, Agent, or Firm* — Waters Technologies Corp

(57) ABSTRACT

A detachable and replaceable ion source for a mass spectrometer. The ion source comprises a housing which defines an ion source chamber, an ion source mounting means complementary to mounting means on the mass spectrometer to detachably couple with the mass spectrometer. This allows movement of the housing to bring the ion source chamber into a position of use at the inlet of said mass spectrometer and to take the ion source chamber from said position of use into a retracted position. Sealing means is provided to create an air tight seal between the housing and the mass spectrometer when the ion source chamber is in its position of use. A release mechanism is provided which cooperates with the mass spectrometer to allow the said movement of said housing.

13 Claims, 5 Drawing Sheets

MASS SPECTROMETER

The present invention relates to the field of mass spectrometry.

BACKGROUND ART

Mass spectrometers are expensive instruments that can be used for the analysis of many different types of analytes. In order to analyse some of these analytes, different methods of ionisation may be required.

It would therefore be useful for a user to be able to switch quickly and easily between different types of ion sources as and when they are required. However, different types of ionisation techniques may require rather different conditions or parts. Therefore, it would be useful to have easily attachable and removable sources for the different ionisation techniques so that users can simply, and quickly change the way they ionise their samples in a safe and secure manner. A further advantage to this is that during maintenance, if any failure has occurred in the source, a new source enclosure may be fitted to reduce downtime of the instrument in question.

In many cases, samples may be run with potentially dangerous chemicals as solvents. For example, most LC methods utilise acetonitrile or methanol, which are heated in the MS source to form toxic vapours. If a source enclosure is detached so that another source enclosure can be placed upon the instrument, it may therefore be extremely important to provide an air tight seal between the ion source chamber and the laboratory. Therefore, it is very important that the source can be tested upon mounting to the instrument so that any leaks that may be present between the source chamber and the laboratory can be identified before the instrument is allowed to intake sample, thus stopping any potential leakage of dangerous chemicals.

When in use, failures in the exhaust systems of the mass spectrometer may cause a dangerously over pressurized source. Therefore, a continued diagnostic analysis of the source to recognize any blockages before they raise the pressure to a dangerous level would be desirable.

If the exhaust system is at a pressure above that of the ion source chamber, a backflow may occur from the exhaust into the mass spectrometer. This may cause interferences in the results of the system, or if the source is unlocked at the time, this may cause the laboratory to be contaminated with potentially hazardous chemicals. Therefore, an additional back flow prevention means would also be desirable so that this condition can be avoided.

Therefore, a new, easily detachable and reattachable ion source with all the above features would be desirable.

SUMMARY OF THE INVENTION

The invention provides a detachable and replaceable ion source for a mass spectrometer having a mass spectrometer mounting for detachably receiving said ion source, the ion source comprising a housing which defines an ion source chamber, an ion source mounting means complementary to said mass spectrometer mounting to detachably couple with said mass spectrometer and to allow movement of the housing to bring the ion source chamber into a position of use at the inlet of said mass spectrometer and to take the ion source chamber from said position of use into a retracted position, sealing means to create a air tight seal between said housing and said mass spectrometer when the ion source chamber is in said position of use, and a release mechanism that cooperates with said mass spectrometer to allow said movement of said housing.

According to a feature of the invention the ion source mounting and the complementary mass spectrometer mounting may together allow pivotal movement of the ion source housing towards and away from the inlet of said mass spectrometer. Preferably, the ion source mounting and the complementary mass spectrometer mounting together allow translatory movement of the ion source housing when in the retracted position in a direction along the axis of said pivotal movement to allow detachment and replacement of the ion source housing with respect to said inlet of the mass spectrometer.

According to another feature of the invention, pressure sensor means may be provided to allow continuous monitoring of source pressure and periodic leak checking of the source enclosure and wherein the pressure sensor means may be adapted to actuate a pressure check valve to prevent potentially dangerous source over-pressurization occurring in fault conditions. Preferably, the pressure sensor means is operatively connected to an atmospheric pressure ionization (API) solenoid which is adapted to close at a predetermined pressure to protect the pressure sensor means. Preferably, an exhaust isolation valve is provided and operative in the event that API gas is not present to prevent migration of external gases into the ion source.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENT

Figure 1:
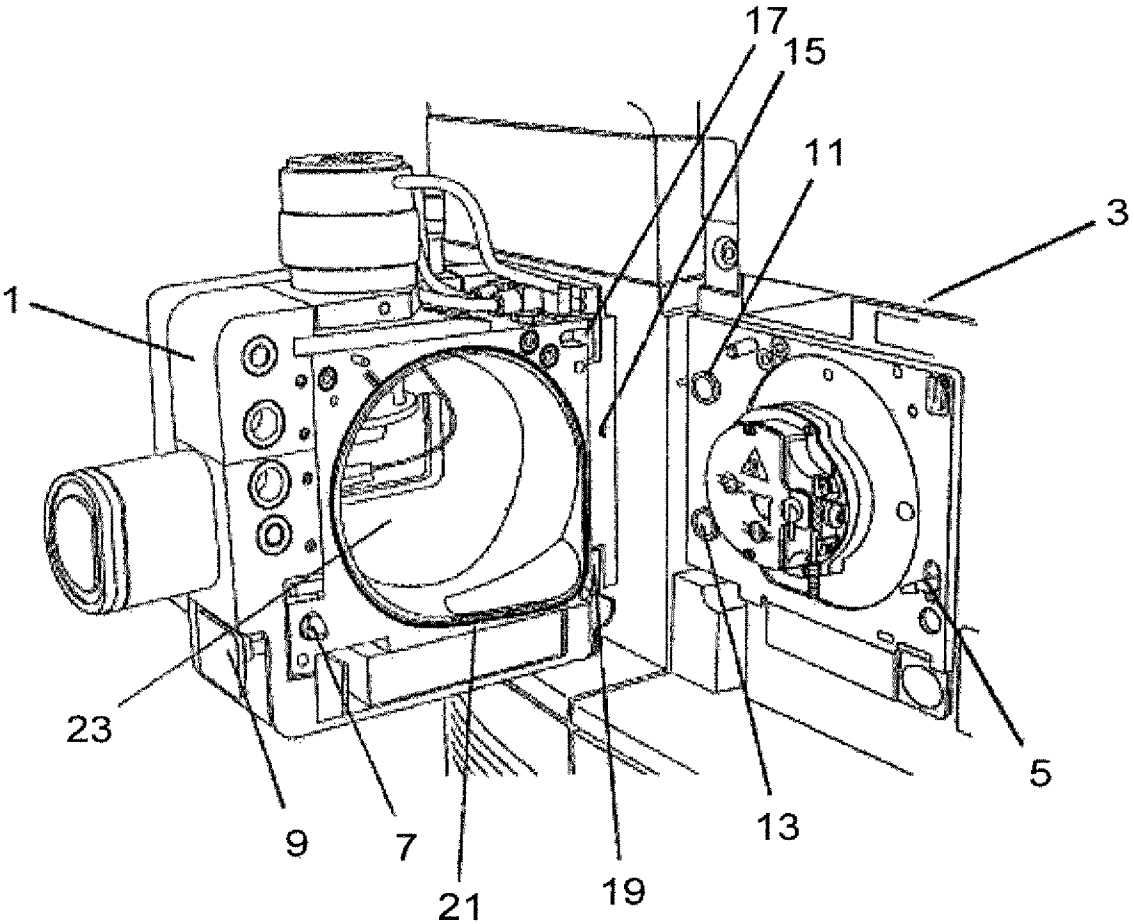
FIG. 1 shows a partially detached source enclosure in the vicinity of the mass spectrometer in accordance with the invention.

FIG. 1 is a diagram of an ion source in accordance with the current invention. The source (1) is hinged away from, and thus retracted from, but proximal to, the mass spectrometer (3). The ion source detachably latches on to the mass spectrometer by a complementary latch mechanism (5) on the mass spectrometer and release mechanism (7) upon the ion source housing. The release handle (9) actuates release mechanism 7 so as to release the ion source from the mass spectrometer when in a closed position of use so that it can be hinged into the retracted position as shown.

The source may be mounted on the mass spectrometer by way of mounting points (11 and 13) and corresponding mounting cavities (not shown) upon the source at a mounting plate (15). The mounting plate is hingably attached to the main source body by a plurality of hinges (17 and 19). A seal (21) seals the ion source to the mass spectrometer so that the source enclosure (23) is sealed in an air tight manner.

Figure 2:
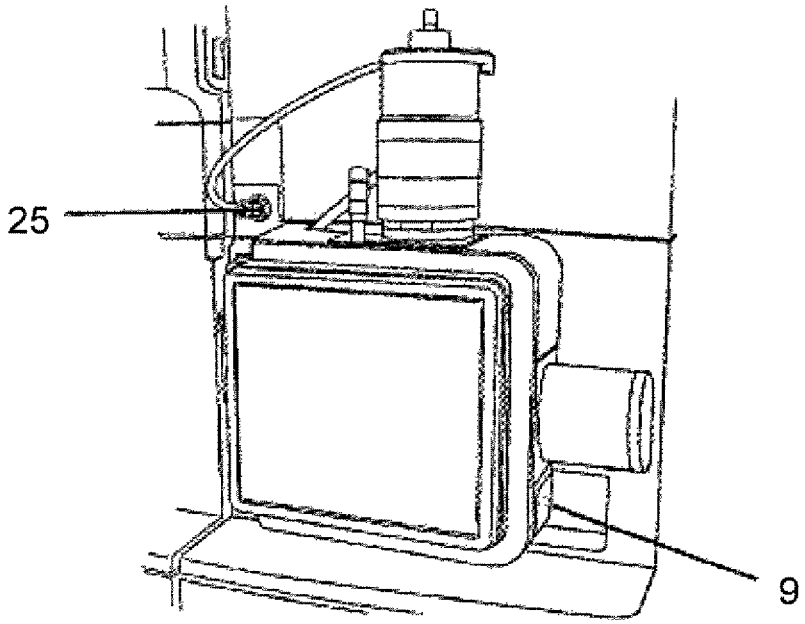
FIG. 2 shows an attached source enclosure fitted to the mass spectrometer.

FIG. 2 shows the ion source in an attached position of use, such that it is sealed to the mass spectrometer. In order to release the ion source, the user removes the inlet connections from the mass spectrometer (25). Once these connections have been removed, the release handle (9) is pulled outwards in order to release the source from the latch on the mass spectrometer.

Figure 3:
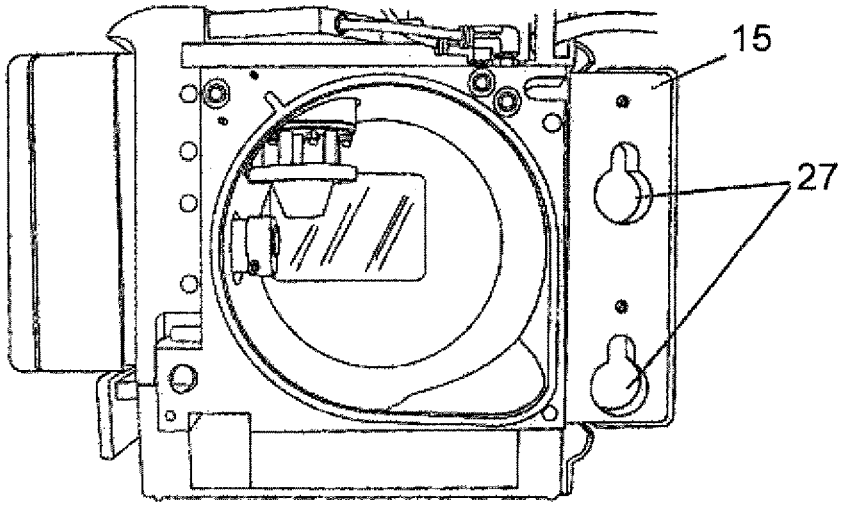
FIG. 3 shows a view of the source form the side at which it fits on to the mass spectrometer.

FIG. 3 shows the ion source from the side at which it fits on to the mass spectrometer. The mounting cavities (27) upon the mounting plate (15) are arranged such that upon attachment to the mounting points, the source enclosure is securely fitted to the instrument. In order for the source to be detached from the mounting points the source must be lifted off the mounting points upon the mass spectrometer. Thus the ion source housing is moved in a direction along the axis of its pivotal connection when in its open, retracted position.

Figure 4:
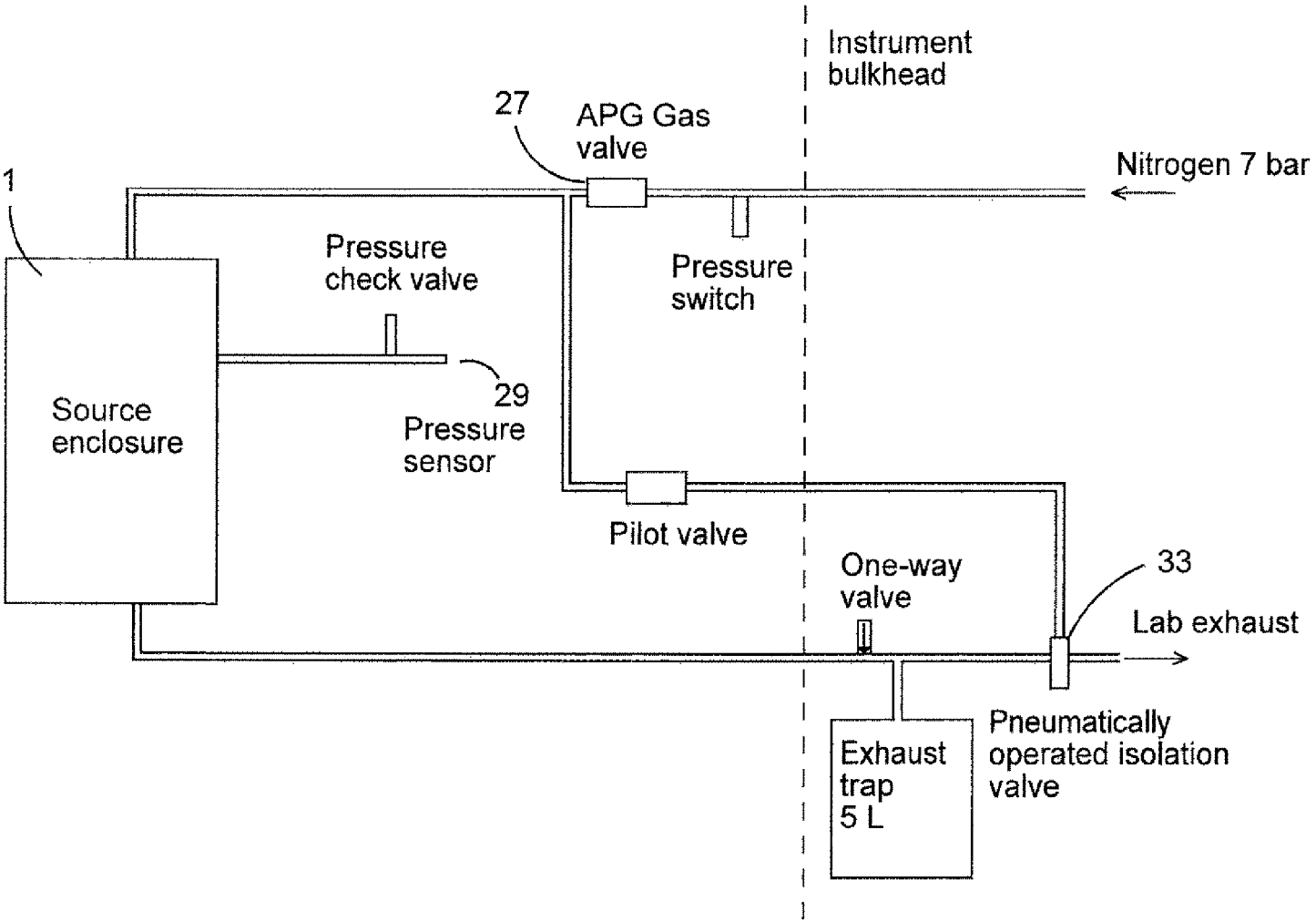
FIG. 4 is a schematic diagram of a system incorporating an ion source and a mass spectrometer, according to the invention.

Referring now also to FIG. 4, every time the user closes the source enclosure or inserts a probe the source is briefly pressurized to test for leaks. Desolvation gas is injected into the ion source chamber through value 27 and the pressure in the chamber is monitored by means of a pressure sensor 29. If the pressure of the source chamber drops significantly the test (a leak test) would be failed. If the test result is a fail the user is warned or otherwise prevented from using the source in a potentially unsafe condition. The test takes about 30 seconds to complete.

The leak test may be initiated automatically, 5 seconds after the source is closed or the probe is inserted or manually. If the leak test fails, a prominent message warns the user.

The source enclosure pressure sensor 29 allows continuous monitoring of source pressure and periodic leak checking. The pressure sensor will indicate excessive pressure caused by blocked or partially blocked exhausts.

A pressure check valve 31 prevents potentially dangerous source over-pressurisation occurring in fault conditions.

The pressure sensor 29 is hardware interlocked to the API gas solenoid valve 27, such that the API gas solenoid will close if the pressure exceeds 100 mbar in normal use, protecting the pressure sensor and the user.

The pressure warning at >25 mbar will ensure low pressure exhaust systems are used, giving low source pressures and therefore reduced leakage rates in fault conditions.

When the API gas is switched off or in the event of API gas failure, an exhaust isolation valve 33 closes, preventing any migration of gases from the laboratory exhaust system into the source 1.

The instrument exhaust is connected to the laboratory exhaust via a leak-tight union 35. This prevents any possible leakage of source gases into the laboratory atmosphere if the laboratory exhaust system is inadequate, i.e. where the exhaust pressure exceeds atmospheric pressure.

Figure 5:
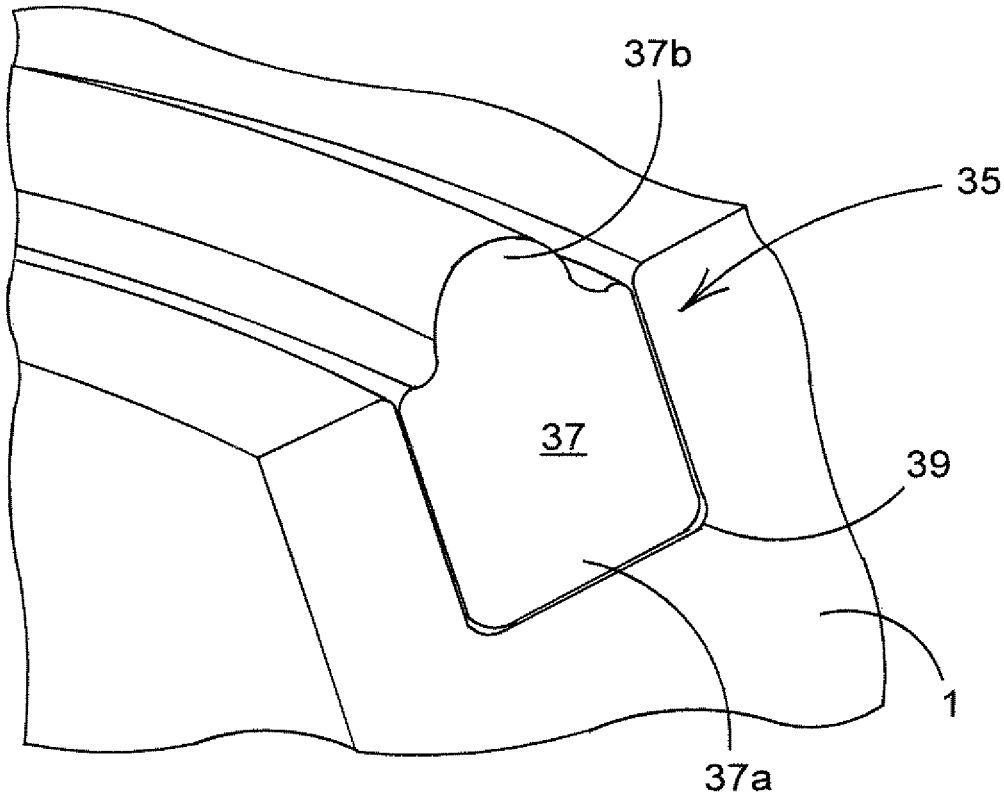
FIG. 5 illustrates a seal which seals between the ion source enclosure and the inlet of the mass spectrometer.

Referring now to FIG. 5, the ion source incorporates a seal system 35 which provides an enhanced seal between the ion source chamber and the inlet of the mass spectrometer.

The seal 37 of seal system 35 has a deep seal profile which allows the seal to stay in place when the source is opened and closed. As can be seen the seal 37 has a substantially rectangular base 37*a* by which it is securely mounted in groove 39 of the ion source enclosure, and an arcuate domed exposed portion 37*b* which gives enhanced deformation. This seal profile depth gives a greater cross section of rubber, allowing a greater contact surface on the seal face and greater deformation of the seal. As the compression increases, the excess material spreads sideways to increase the contact land. The profile of the seal has also been made so that trapping of solvent/debris is reduced, the profile can easily be wiped clean for extended performance. Seals 37 are easily fitted by users, unlike conventional captive o-rings.

Other Embodiments

The invention gives a number of benefits including the protection of both source and exhaust system, a reduced risk of exposure to harmful solvent vapours, protection of MS system from contamination via laboratory exhaust and a system which is completely automated requiring no user intervention.

It will be apparent that various modifications may be made to the particular embodiments discussed above without departing from the scope of the invention.

The invention claimed is:

1. A detachable and replaceable ion source for a mass spectrometer having a mass spectrometer mounting for detachably receiving said ion source, the ion source comprising:

a housing with an open side which defines an ion source chamber, an ion source mounting means complementary to said mass spectrometer mounting to detachably couple with said mass spectrometer and to allow movement of the housing to bring the ion source chamber into a position of use at the inlet of said mass spectrometer and to take the ion source chamber from said position of use into a retracted position, sealing means to create an air tight seal between said housing and said mass spectrometer in order to seal said ion source chamber when the ion source chamber is in said position of use, and a release mechanism that cooperates with said mass spectrometer to allow said movement of said housing, wherein said sealing means comprises a seal with a substantially rectangular base mounted in a groove of said housing and an arcuate domed exposed deformable portion.

2. A mass spectrometer having a detachable and replaceable ion source according to claim 1, wherein the ion source mounting and the complementary mass spectrometer mounting together allow pivotal movement of the ion source housing towards and away from the inlet of said mass spectrometer.

3. A mass spectrometer according to claim 2 wherein the ion source mounting and the complementary mass spectrometer mounting together allow translatory movement of the ion source housing when in the retracted position in a direction along the axis of said pivotal movement to allow detachment and replacement of the ion source housing with respect to said inlet of the mass spectrometer.

4. A mass spectrometer according to claim 2 or claim 3, wherein pressure sensor means is provided to allow continuous monitoring of source pressure and periodic leak checking of the source enclosure and wherein the pressure sensor means is adapted to actuate a pressure check valve to prevent potentially dangerous source over-pressurization occurring in fault conditions.

5. A mass spectrometer as claimed in claim 4, wherein said pressure sensor means is operatively connected to an atmospheric pressure ionization (API) solenoid which is adapted to dose at a predetermined pressure to protect the pressure sensor means.

6. A mass spectrometer as claimed in claim 5, wherein an exhaust isolation valve is provided and operative in the event that API gas is not present to prevent migration of external gases into the ion source.

7. A detachable and replaceable ion source for a mass spectrometer having a mount for detachably receiving said ion source, said ion source comprising:

a housing with an open side which: defines an ion source chamber, an ion source mount for detachably coupling said housing with said mass spectrometer mount such that said housing is movable between a retracted position and a position of use in which said ion source chamber is in communication with an inlet of said mass spectrometer, and a release mechanism that cooperates with said mass spectrometer to selectively allow said movement of said housing, wherein an air tight seal is created between said open side of said housing and said mass spectrometer when said housing is moved, in use, from said retracted position to said position of use, and said seal comprises a substantially rectangular base mounted in a groove of said housing and an arcuate domed exposed deformable portion.

8. A mass spectrometer comprising a mount to which a detachable and replaceable ion source according to claim 7 is detachably coupled and a leak detector, wherein said leak detector is configured, when said housing is moved, in use, from said retracted position into said position of use, to pressurize said ion source chamber, to monitor a pressure in said ion source chamber, and to detect a leak if said monitored pressure drops by a predetermined amount.

9. A mass spectrometer as claimed in claim 8, wherein said leak detector comprises a pressure sensor to allow continuous monitoring of a pressure in said ion source and wherein said pressure sensor is adapted to actuate a pressure check valve to prevent potentially dangerous source over-pressurization occurring in fault conditions.

10. A method of detecting leaks in a mass spectrometer that includes a detachable and replaceable ion source, the method comprising the steps of:

moving a housing of said detachable and replaceable ion source to bring an ion source chamber of said housing from a retracted position into a position of use at an inlet of said mass spectrometer, pressurizing said ion source chamber, monitoring a pressure in said ion source chamber, and detecting a leak if said monitored pressure drops by a predetermined amount.

11. A method of detecting leaks in a mass spectrometer as claimed in claim 10, the method further comprising warning a user of said failure.

12. A method of detecting leaks in a mass spectrometer as claimed in claim 10, the method further comprising disabling said detachable and replaceable ion source in response to a leak being detected.

13. A mass spectrometer control system configured to detect leaks using a method as claimed in claim 10.

* * * * *